United States Patent [19]

Taylor

[11] Patent Number: 5,027,442

[45] Date of Patent: Jul. 2, 1991

[54] NOVELTY BELT

[76] Inventor: Reginald D. Taylor, 86 Sycamore St., Somerville, Mass. 02143

[21] Appl. No.: 425,430

[22] Filed: Oct. 23, 1989

[51] Int. Cl.[5] ..... A41F 9/00; A63H 5/00

[52] U.S. Cl. ..... 2/338; 2/300; 446/415

[58] Field of Search ..... D2/627, 628, 629, 631, D2/632; 2/300, 322, 338, DIG. 6, 311, 312; 446/415, 184, 193, 297, 303, 28; 24/163 FC, 163 K; 84/402 A, 402 C, 402; 116/167, 171, 172, 148

[56] References Cited

U.S. PATENT DOCUMENTS

| | | | |
|---|---|---|---|
| D. 39,679 | 12/1908 | Hauser | D2/629 |
| 1,206,933 | 12/1916 | Simonds et al. | 446/415 |
| 1,716,689 | 6/1929 | Freemark | D2/628 |
| 3,184,883 | 5/1965 | McCook | 2/311 X |
| 3,458,188 | 7/1969 | Infante | 2/312 X |
| 3,538,637 | 11/1970 | Smith | 446/415 |
| 3,642,276 | 2/1972 | Kropf | 2/312 |
| 3,777,310 | 12/1973 | Yang | 446/28 |
| 4,514,883 | 5/1985 | Barbieri et al. | 446/28 |
| 4,715,839 | 12/1987 | Ford | 24/163 X |
| 4,810,997 | 3/1989 | Kudo et al. | 446/297 |
| 4,847,919 | 7/1989 | Hwang et al. | 2/338 |

OTHER PUBLICATIONS

"Self-Adhering Nylon Tapes", Journal of A.M.A., vol. 168, No. 7, Oct. 19, 1958.

*Primary Examiner*—William A. Cuchlinski, Jr.
*Assistant Examiner*—Alvin Wirthlin
*Attorney, Agent, or Firm*—John P. McGonagle

[57] ABSTRACT

A novelty belt in the form of a combination belt and noisemaker. The belt has fastener means with a noisemaker attached which is activated when external pressure is applied.

2 Claims, 5 Drawing Sheets

NOVELTY BELT

BACKGROUND OF THE INVENTION

This invention relates generally to articles of apparel and more particularly to novelty belts in the form of a combination belt and noise maker.

Many commercially available belts include fasteners which are decorative. However, with the exception of U.S. Pat. No. 176,083 to J. R. Smith, none provide fasteners which also provide noise when touched. Smith provides a buckle which has suspended from it a bell. However, the Smith bell rings without being touched. Belt fasteners with noisemakers incorporated therein have wide novelty application such as in dancing or as entertainment for children.

Accordingly, it is a general object of the instant invention to provide wearing apparel in the form of a novelty item of a combination belt and noisemaker which overcomes the disadvantages of the prior art.

It is a further object of the instant invention to provide a novelty item in the form of a belt having a fastener which incorporates a noisemaker which is activated by an external touch.

SUMMARY OF THE INVENTION

These and other objects of the instant invention are achieved by providing a novelty item in the form of a combination belt and noisemaker. The novelty item comprises a band of material having a pair of ends and adapted to encircle the waist or hips and fastener means secured to the band. The fastener means includes a first member secured to one end of the band and a second member secured to the other end of the band. The members are arranged to be releasably secured to each other. The fastener means includes a noisemaker which is activated when external pressure is applied.

DETAILED DESCRIPTION OF THE INVENTION

Figure 1:
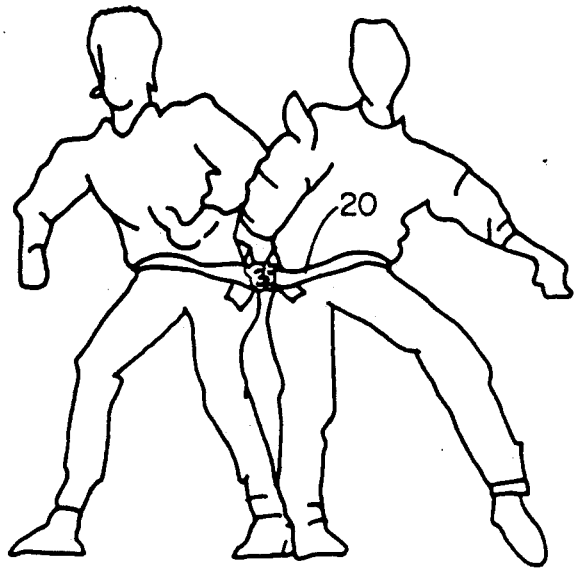
FIG. 1 is a view of two persons using a belt embodying the invention and shown dancing.
Figure 2:
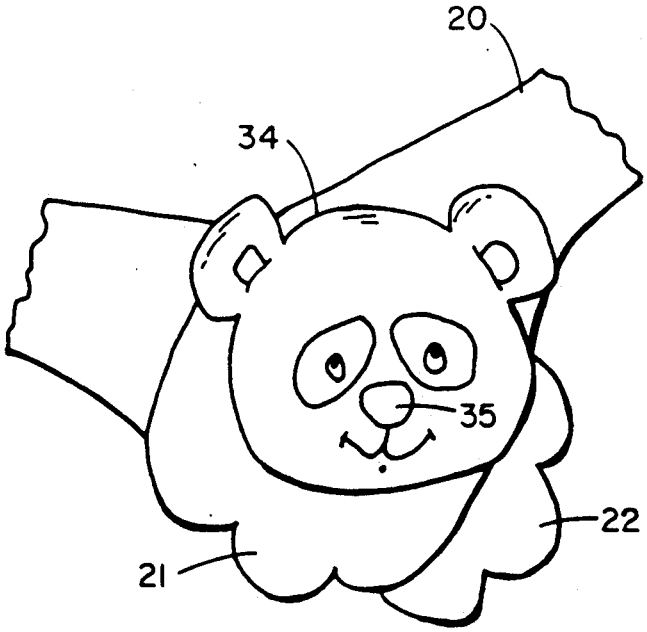
FIG. 2 is a partial front view of the invention.
Figure 3B:
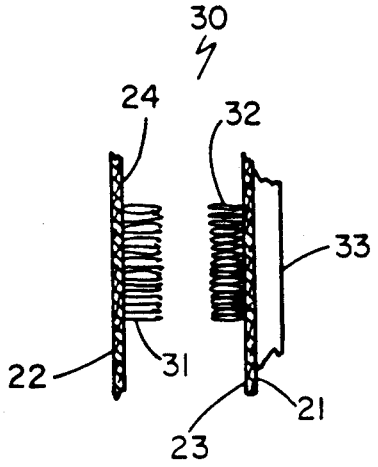
FIG. 3B is a close side view of the Velcro fastener.
Figure 3A:
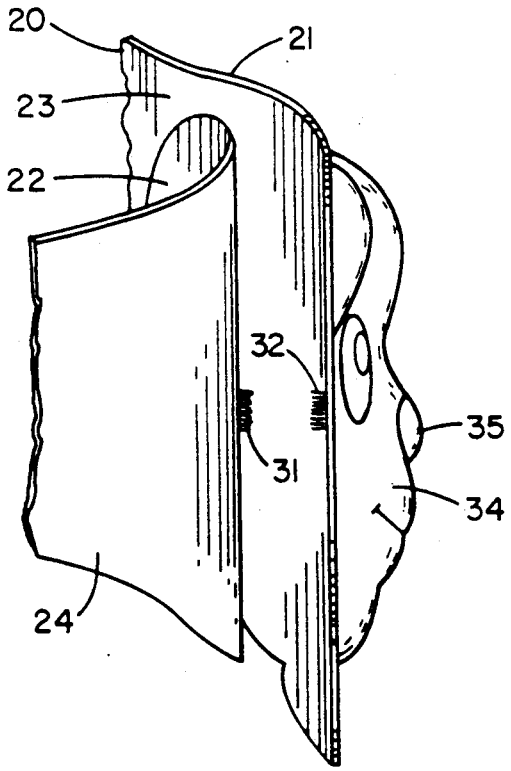
FIG. 3A is a partial side view of the invention using a Velcro fastener in an unfastened state.
Figure 4B:
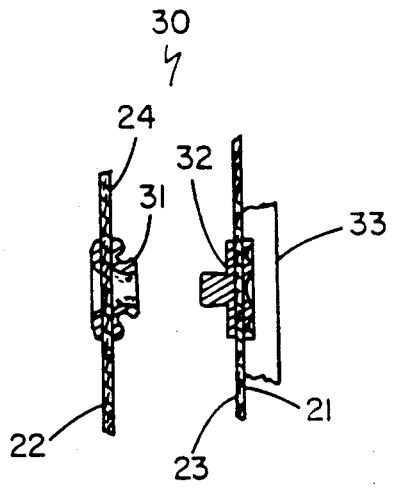
FIG. 4B is a close side view of the snap fastener.
Figure 4A:
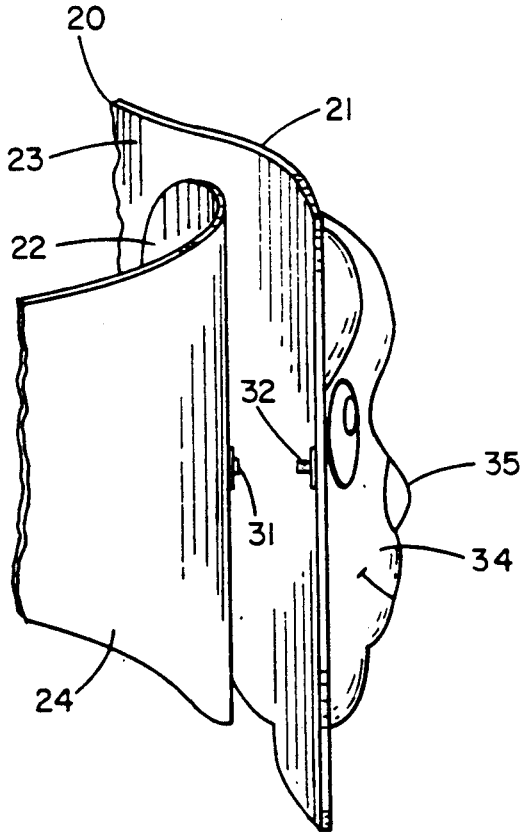
FIG. 4A is a partial side view of the invention using a snap fastener in an unfastened state.
Figure 5:
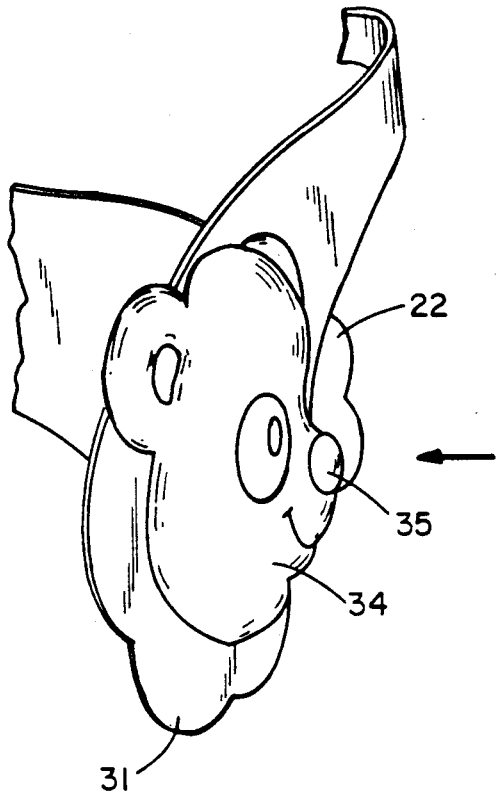
FIG. 5 is a perspective view of a portion of the invention.
Figure 6:
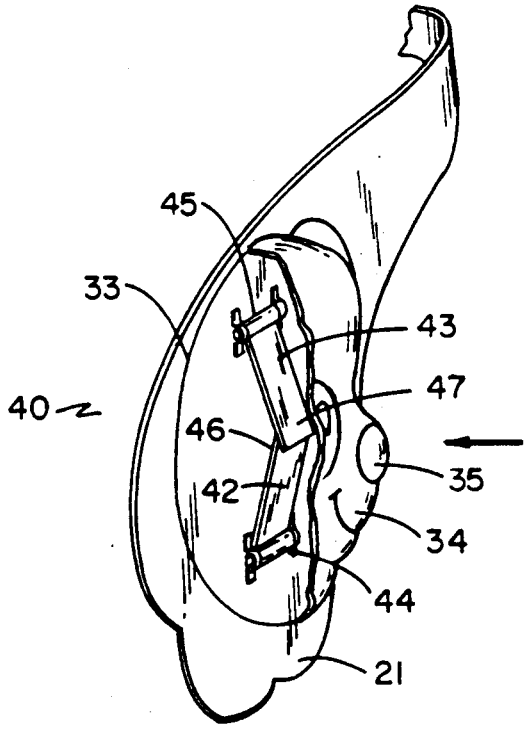
FIG. 6 is a partially cut away perspective view of one embodiment of the invention.
Figure 7:
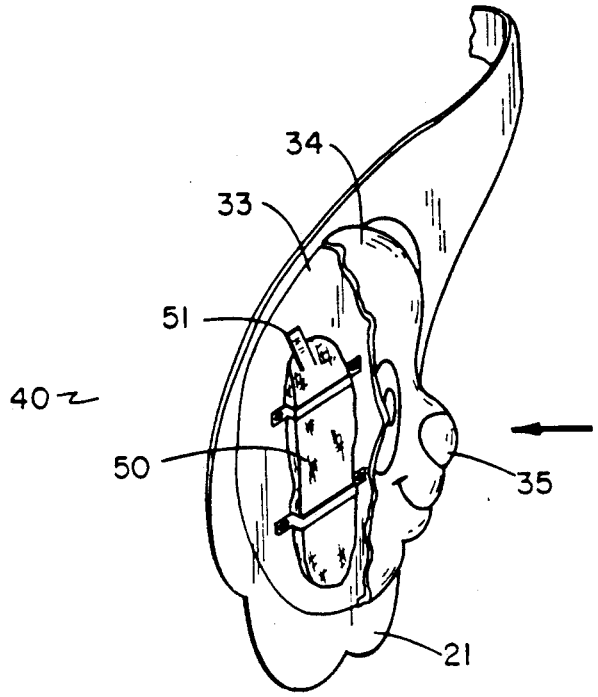
FIG. 7 is a paritally cut away perspective view of another embodiment of the invention.
Figure 8:
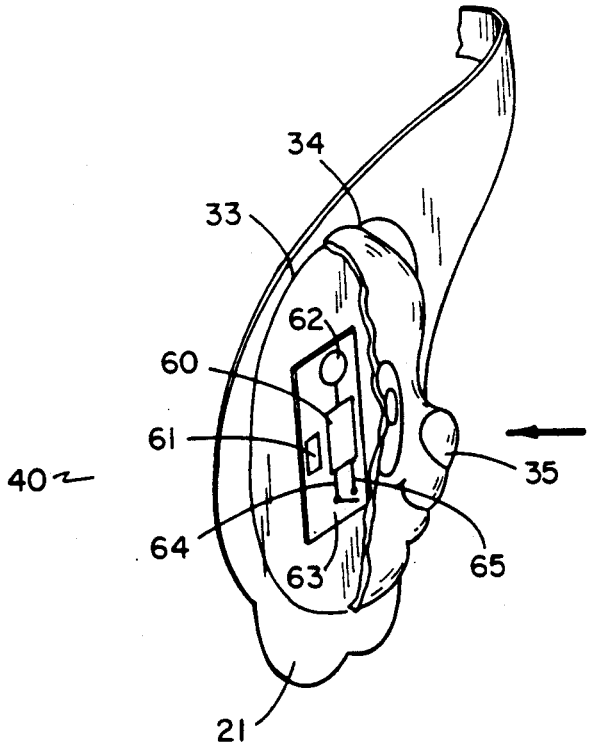
FIG. 8 is a partially cut away perspective view of still another embodiment of the invention.

Referring more particularly to the drawings wherein like numerals indicate like elements, the invention is comprised of a belt 20 having a fastener 30 (FIGS. 3B and 4B) to which there is attached a noisemaker 40 (FIGS. 6–8). The belt 20 is of conventional construction and comprises a web of fabric, leather, plastic, etc. Referring to FIGS. 3A and 4A the belt 20 includes a first end 21 to which one portion 31 of a fastener 30 is fixedly secured. The other end 22 of the belt 20 is attached to the second, mating portion 32 of the fastener 30.

As shown in FIG. 4 the fastener 30 in the preferred embodiment may be either a snap button or two Velcro strips. The two mating halves 31 and 32 of the snap button 30 would be attached near to the belt ends 21 and 22, respectively. If Velcro is used, then as shown in FIG. 3A one Velcro strip 31 would be fixedly attached near to the belt first end 21 and the other Velcro strip 32 would be fixedly attached near to the belt second end 22. In either case the fastener portions 31 and 32 would be attached to opposite belt faces 23 and 24 and adapted to matingly engage each other, thereby fastening the belt ends 21 and 22.

The noisemaker 40 may be one of three types: mechanical (FIG. 6), bladder (FIG. 7), or electronic (FIG. 8). If mechanical, then the noisemaker 40 would be comprised of two flat, rectangular, stiff, metallic members 42 and 43, each having the same general longitudinal axis and lying in the planes at an angle to one another. Each member 42 and 43 has one opposite end 44, 45 fixedly attached to a flat, shaped, plate-like member 33 attached to the mating portion 32 of the fastener 30 (FIGS. 4A and 4B). The free ends 46 and 47 of the members 42 and 43 slightly overlap. When external pressure is placed on the member 43, its tip 47 pushes past the tip 46 and returns to its original position after the pressure is released, thereby causing a "clicking" sound. A flexible, concave-shaped plate 34 is placed over the noisemaker 40 and attached to the plate-like member 33. External pressure on the approximate center 35 of the plate 34 activates the "clicking" sound of the noisemaker.

If the noisemaker 40 (FIG. 7) is of the bladder type, then it is comprised of a bladder 50 fixedly attached to the plate-like member 33. The bladder 50 has a valve 51 which flutters when the bladder 50 is pressed, thereby causing a conventional "bladder" sound. The shaped plate 34 is mounted over the bladder and fixedly attached to the member 33. Pressure on the plate center 35 is transferred to the bladder 50 thereby activating the valve 51 and generating noise.

The noisemaker 40 (FIG. 8) may also be of the electronic type. An electronic circuit chip 60 which is essentially a tone generator with interconnecting circuitry draws power from a standard watch type battery 61 and drives a small, flat, very thin speaker 62. The switch 63 is merely an on-off switch consisting of two leads 64 and 65 arranged so that pressure on the plate 34 causes the leads 64 and 65 to make contact thereby turning the switch 63 "on". With the switch 63 "on" power is available to the tone generator in the electronic chip 60 and a "buzzing" sound is played on the speaker 62. The electronic noisemaker 40 is laid out flat on and attached to the plate-like member 33.

The flexible, concave-shaped plate 34 may have various shapes, such as heart, bow, animal-like faces, etc. It is understood that the above-described embodiment is merely illustrative of the application. Other embodiments may be readily devised by those skilled in the art which will embody the principles of the invention and fall within the spirit and scope thereof.

I claim:

1. A novelty item in the form of a combination belt and noisemaker, comprising:

a band of material having a pair of ends and adapted to encircle the waist of a wearer;

fastener means secured to said band for releasably securing the ends of said band together; and a noisemaker attached to said fastener means, responsive to and actuated by an external pressure, said noisemaker being comprised of first and second flat, rectangular, stiff, metallic members, each having the same general longitudinal axis and lying in planes at an angle to one another, wherein each member has one opposite end fixedly attached to a flat, plate-like member attached to said fastener means, and one free end slightly overlapping the other member's free end, whereby when external pressure is placed on the first member, its tip pushes past the other member's tip and returns to its original position after the pressure is released, thereby causing a clicking sound.

2. A novelty item in accordance with claim 1 further comprising:

a flexible, concave-shaped plate placed over the noisemaker and attached to said flat, plate-like member, whereby external pressure on the approximate center of said concave-shaped plate is transferred to said first metallic member thereby activating said noisemaker.

* * * * *